US005078756A

United States Patent [19]

Major et al.

[11] Patent Number: 5,078,756

[45] Date of Patent: Jan. 7, 1992

[54] APPARATUS AND METHOD FOR PURIFICATION AND RECOVERY OF REFRIGERANT

[76] Inventors: Thomas O. Major, 4105 Grey, Denver, Colo. 80212; Jack E. Major, Jr., 1590 Harlan, Lakewood, Colo. 80214

[21] Appl. No.: 464,307

[22] Filed: Jan. 12, 1990

[51] Int. Cl.[5] ..... B01D 50/00

[52] U.S. Cl. ..... 55/21; 62/77; 62/292; 62/195; 55/23; 55/268; 55/274

[58] Field of Search ..... 55/21, 23, 163, 165, 55/168-170, 274, 268, 269, 210-218; 62/474, 475, 503, 509, 512, 149, 77, 292, 195

[56] References Cited

U.S. PATENT DOCUMENTS

| | | | |
|---|---|---|---|
| 2,998,096 | 8/1961 | Snipes | 55/168 |
| 3,216,648 | 11/1965 | Ford | 62/475 |
| 3,844,131 | 10/1974 | Gianni et al. | 62/149 |
| 4,167,102 | 9/1979 | Willitts | 62/509 |
| 4,285,206 | 8/1981 | Koser | 62/149 |
| 4,304,102 | 12/1981 | Gray | 62/475 |
| 4,476,307 | 10/1984 | Goddard | 62/149 |
| 4,805,416 | 2/1989 | Manz et al. | 62/292 |
| 4,809,520 | 3/1989 | Manz et al. | 62/292 |

OTHER PUBLICATIONS

WO89/06336, 7/13/89, Merritt et al. & copy in class 62-149.

*Primary Examiner*—Bernard Nozick

*Attorney, Agent, or Firm*—J. Preston Oxenham

[57] ABSTRACT

A refrigerant purification and recovery apparatus for removing refrigerant from a refrigeration unit and for purifying the refrigerant removed from the refrigeration unit includes a compressor, condenser, a receiver-separator vessel having upper and lower end portions, pressure detection means for generating signals indicative of a pressure in the upper end portion of the receiver-separator vessel, liquid detection means for generating a signal indicative of the presence or absence of liquid in the vessel at a position between the upper and lower end portions, means for venting gas from the upper end portion of the receiver-separator vessel, means for draining liquid from the lower end portion of the receiver-separator vessel, and control-signal means for receiving the pressure indicative and liquid-presence indicative signals and generating a drain signal only when the pressure indicative signal is indicative of a pressure greater than a predetermined pressure and the liquid presence indicative signal is indicative of a liquid present, and generating a vent signal only when the pressure indicative signal is indicative of a pressure greater than a predetermined pressure and the liquid presence indicative signal is indicative of no liquid present.

16 Claims, 3 Drawing Sheets

APPARATUS AND METHOD FOR PURIFICATION AND RECOVERY OF REFRIGERANT

TECHNICAL FIELD

The present invention relates to the recovery of refrigerant from refrigerant charged refrigerating systems and the purification of used refrigerant taken from such systems. More particularly, the present invention relates to the recovery of refrigerant from air conditioning systems prior to their repair or replacement. Most particularly, the present invention relates to the removal and purification of refrigerant from such systems in environments of disparate ambient temperatures.

BACKGROUND OF THE INVENTION

Traditionally, when refrigerant charged refrigeration systems were repaired, the refrigerant charge was simply loosed to the atmosphere as necessary to accomplish the repairs. In recent times, it has become increasingly desireable to capture and reuse the refrigerant charge in these units for two reasons; refrigerant pollution of the atmosphere is perceived as environmentally destructive and the cost of refrigerant materials has increased making the disposal and replacement of the refrigerant charge increasingly costly.

Refrigerant recovery devices of the prior art have compressed and cooled refrigerant from charged systems to a liquid state for storage and reintroduction to the same system after repair has been accomplished or for use in other systems. Many of these prior art recovery systems have employed filtration of the refrigerant during the removal-compression-cooling process to remove contaminants from the used refrigerant. However, devices of the prior art have not provided for the systematic removal of "noncompressible" gas contaminants, i.e. gasses much less compressible than the refrigerant, such as air, from the used refrigerant during the recovery process.

Also, under certain conditions of sufficiently high refrigerant pressure and cool ambient temperatures, some of the prior art systems are susceptible to entry of liquid refrigerant into the suction side of the recovery system compressor which may cause damage to the compressor and power components of the recovery system.

Further, many of the prior art systems may operate satisfactorily only in a limited range of ambient temperature and cannot effectively remove energy from the compressed refrigerant to assure its complete liquification prior to its injection into a storage container when ambient temperatures are very high. Other of the prior art recovery devices may achieve acceptable performance during recovery operations over a wide range of ambient temperatures, but at a concomitant increase in recovery system production cost that makes them economically impractical for purchase by operators providing repair services in any but the most extreme environments.

Many units of the prior art have been of such high cost as to make capture, purification and reintroduction of the refrigerant charge to refrigeration units under repair of questionable economic justification, even in a political climate of increasing environmental concern.

DISCLOSURE OF THE INVENTION

It is an object of the present invention to provide an economic and effective refrigerant recovery and purification system for recovering and purifying refrigerant charges of refrigeration systems for reintroduction to the same refrigeration system or use in another refrigeration system.

It is also an object of the present invention to provide a refrigerant purification system which will remove "noncompressible" gas contaminants from recovered refrigerant in a systematic and economic manner.

It is a further object of the present invention to utilize a method of refrigerant purification which may be adapted to a completely automated system or accomplished with operator observation and interaction with the recovery-purification apparatus.

It is also an object of the present invention to provide an apparatus for refrigerant recovery and purification which will not be subject to compressor damage due to entry of liquid phase refrigerant into the suction side of the compressor of the recovery apparatus.

It is an object of the present invention to provide a refrigerant recovery and purification system which is adaptable to effectively reduce recovered refrigerant to a liquid phase for storage under a wide range of ambient temperatures.

It is yet a further object of the present invention to provide a refrigerant recovery system which may be manufactured at a low cost, yet may be adapted as necessary to perform effectively in very high ambient temperature conditions.

In accordance with these objectives, a refrigerant purification and recovery apparatus comprising the present invention includes a compressor, a condenser and a receiver-separator vessel. A first conduit is provided with a valve and connecting means at a first end for connecting the purification-recovery apparatus in fluid communication with the fluid circuit of a refrigeration unit from which refrigerant is to be removed and purified, and a second end of the first conduit is connected to the suction side of the compressor. A high pressure side of the compressor is connected in fluid communication with an upstream end of the condenser by a second conduit. A third conduit has an upstream and connected to a downstream end of the condenser and a downstream end connected to the receiver-separator vessel at a location between a top portion and a bottom portion of the vessel. A gas vent valve is provided in an upper most portion of the receiver-separator vessel for venting gas from the receiver-separator vessel to the atmosphere, and a drain valve is provided in a lower most portion of the receiver-separator vessel for draining fluid from the receiver-separator vessel into a temporary refrigerant storage container placed in fluid communication with the drain valve. In a preferred embodiment of the purification-recovery system, filters are placed in the first and second conduits to mechanically and chemically remove water, oil and other contaminants from the refrigerant drawn from the refrigeration system.

During operation of the refrigerant purification and recovery apparatus comprising the present invention, refrigerant is drawn from the refrigeration system through the first conduit and the first filter to the suction side of the compressor. The refrigerant is compressed and flows at high pressure through the condenser where heat of compression is removed by heat exchange with surrounding fluid before the refrigerant passes through the third conduit and its filter and into the receiver-separator vessel. Pressure in the receiver-separator vessel is maintained sufficiently high that refrigerant in liquid phase will accumulate in the bottom of the receiver-separator vessel where it may be periodically drawn off to a storage container. Refrigerant in gas phase will fill the remaining volume of the receiver-separator vessel above the liquified refrigerant together with "noncompressible" contaminants, such as air, helium, nitrogen etc., which will remain in gas phase at the pressure and temperature within the receiver-separator vessel. These gases are of lower molecular weight than the refrigerant and will accumulate at the upper most extreme of the receiver-separator vessel above the gaseous refrigerant where they may be bled off from time to time through the vent valve at the top of the receiver-separator vessel.

The purification and recovery apparatus also includes a pressure sensor for sensing pressure in the upper portion of the receiver-separator vessel and generating a signal indicative of that pressure and a liquid sensor for sensing the presence of a liquid at a point in the receiver-separator vessel below the connection point of the third conduit to the vessel, and generating a signal indicative of the pressure of a liquid. A control-signal device is provided to receive the pressure indicative signal and liquid presence indicative signal and to prompt a user of the recovery-purification apparatus, by use of colored lights, LCD displays or other display devices, to open the vent and drain valves in an appropriate manner. When the pressure in the receiver-separator vessel rises above a predetermined pressure and liquid is sensed at the sensor point within the vessel, the control-signal device displays a prompt to prompt the operator to open the drain valve for a limited duration to drain liquid from the receiver-separator vessel to the storage container. When the pressure in the vessel raises above a predetermined pressure and no liquid is sensed at the sensor point within the vessel wall, the operator is prompted to open the vent valve at the top of the vessel for a limited time to vent off "noncompressible" contaminants from the vessel. An alternative embodiment of the refrigerant purification and recovery device of the present invention may utilize valve control means, for example, solenoid valve controls, to drain fluid and vent gas from the vessel in response to signals from the control-signal device.

The third conduit of a refrigerant recovery and purification apparatus comprising a preferred embodiment of the present invention includes an auxiliary valve for blocking flow through the conduit at a point between the third conduit upstream end and the third conduit downstream end when the valve is in a closed condition. A first connector with a Schrader-type valve is provided at a point between the auxiliary valve and the third conduit upstream end and a second connector with a Schrader-type valve is provided on the third conduit at a point between the auxiliary valve and the third conduit downstream end. An auxiliary condenser, with an upstream end and a downstream end adapted to connect with the first and second connector, respectively, may be connected to the first connector at the upstream condenser end and connected with the second connecter at the downstream condenser end and the auxiliary valve placed in the closed condition to cause fluid flowing through the third conduit to pass through the auxiliary condenser to undergo further heat transfer before flowing into the receiver-separator vessel.

From the above description, it may be understood that the method employed by refrigerant purification and recovery apparatus comprising the present invention includes compressing the refrigerant; passing the refrigerant through a condenser to remove heat from the refrigerant; passing the refrigerant into a contaminant vessel with a vent valve at its top and a drain valve at its bottom; sensing a liquid level of liquid refrigerant in a bottom portion of the vessel; sensing the pressure of gaseous refrigerant in a top portion of the vessel; allowing gas to vent from the top of the vessel only when the liquid refrigerant is below a predetermined level and the gas pressure is above a predetermined pressure, and allowing liquid to drain from the bottom of the vessel only when the liquid refrigerant is above a predetermined level and the gas pressure is above a predetermined pressure.

Other objects, advantages and aspects of the invention will become apparent upon reading of the following detailed description and claims and upon reference to the accompanying drawings.

DETAILED DESCRIPTION OF THE INVENTION

Figure 1:
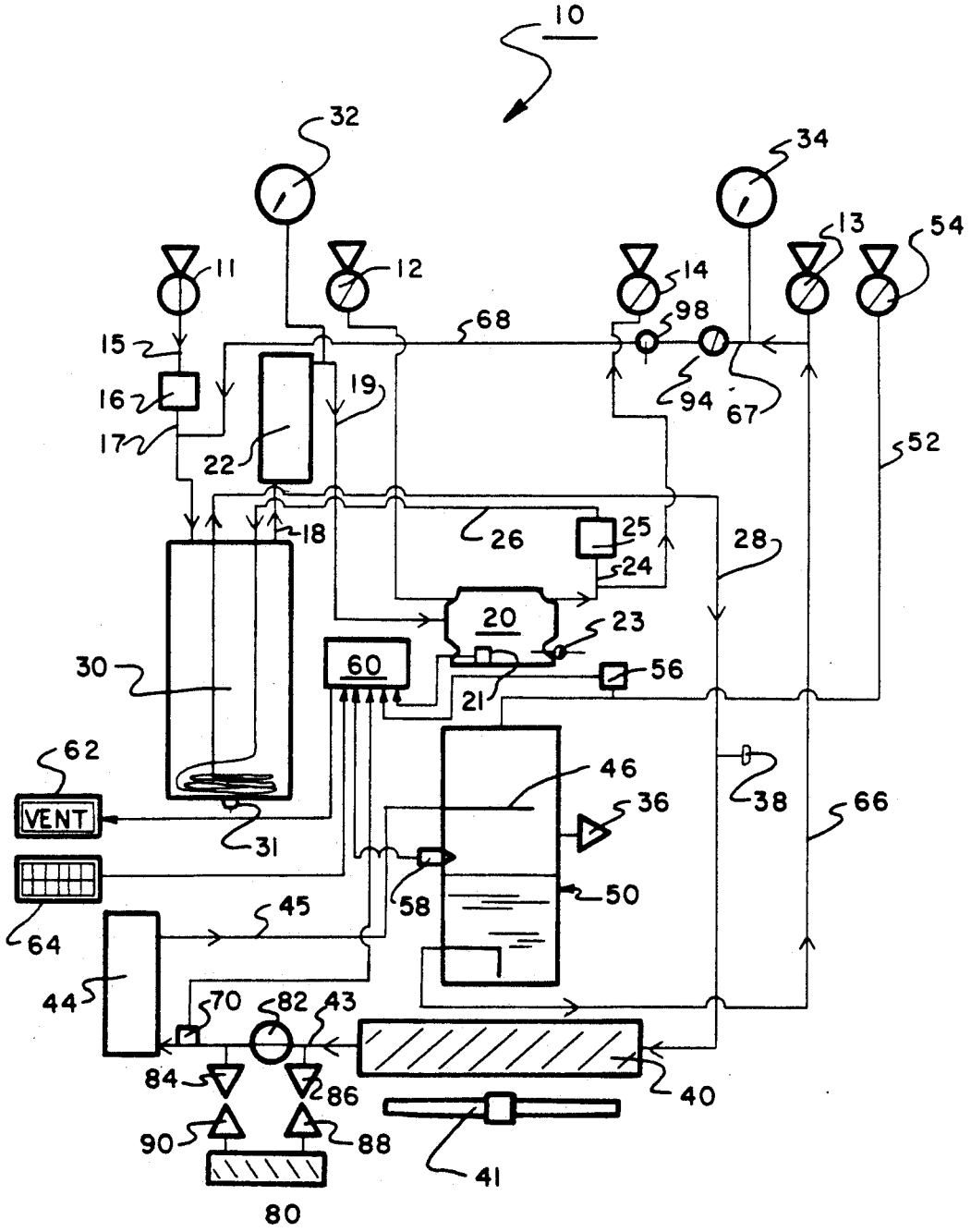
FIG. 1 is a schematic drawing of the fluid circuit of a refrigerant purification and recovery apparatus including a preferred embodiment of the present invention.

A schematic representation of a refrigerant purification and recovery apparatus comprising an embodiment of the present invention is shown in FIG. 1. When refrigerant purification and recovery apparatus 10 is in use, input connection valve 11 is connected to the fluid circuit of the refrigeration unit from which the refrigerant is to be removed via means of conduits, such as suction hoses, adapted for connection to connectors provided on the refrigeration unit, generally near the suction side of the refrigerant unit compressor. When the recovery-purification process is begun by opening an outlet valve on the refrigeration unit, opening input valve 11 and providing power to compressor 20 of the recovery-purification apparatus 10, refrigerant is drawn from the refrigeration unit through input connection valve 11, conduit 15, check valve 16, and conduit 17 into heat exchanger 30. From heat exchanger 30, the refrigerant passes through conduit 18 to suction filter 22. Suction filter 22 is a highly desiccant filter and also contains, for example, alumina and phosphate to mechanically and/or chemically remove both water and acid from the refrigerant to the extent possible while the refrigerant is still in gaseous phase. From suction filter 22 the refrigerant is drawn through conduit 19 to the suction side of compressor 20. The refrigerant leaves compressor 20 at an elevated pressure of for example 250 psi and temperature, and flows through conduit 24, check valve 25 and conduit 26 to return to heat exchanger 30. In heat exchanger 30, thermal energy is drawn from the compressed refrigerant by refrigerant in the suction side refrigerant flow. This assures that the refrigerant drawn from the refrigerant unit is in a single phase gas flow when passing through suction filter 22 and into the suction side of compressor 20.

Oil contaminants suspended in the recovered refrigerant may precipitate from the suction side flow as it passes through heat exchanger 30 and accumulate in the bottom portion of heat exchanger 30. Drain valve 31 is provided at the base of heat exchanger 30 to allow any accumulated oil to be periodically drawn off and discharged.

From heat exchanger 30, the high pressure refrigerant flows through conduit 28 to condenser 40. In condenser 40, the high temperature-pressure refrigerant is cooled by heat exchange with an external fluid, such as ambient air, and begins condensation to a liquid phase. Air cooling may be augmented by fan 41, or another fluid, such as cold water, may be flushed over condenser 40 to enhance heat exchange. The condensed refrigerant then passes through conduit 43, liquid filter 44 and conduit 45 into receiver-separator vessel 50. Filter 44 may be of any of the materials well known to those of the art, which mechanically and/or chemically remove water or acid from the refrigerant before it enters the receiver-separator 50.

Receiver-separator 50 of refrigerant recovery-purification apparatus 10 embodying the present invention, is vertically oriented such that denser, liquid-phase refrigerant will accumulate in a lower portion of the receiver-separator vessel with higher gas-phase refrigerant and gaseous "noncompressible" contaminants, residing above the liquid phase refrigerant. The "noncompressible" contaminants, for example, air, helium, nitrogen etc., are of lower molecular weight than the refrigerant, and, thus, will occupy the upper most portion of vessel 50, above the gaseous refrigerant.

Vent line conduit 52 leads from the upper most portion of receiver-separator vessel 50 to vent valve 54, which may be opened to vent gas from the upper portion of vessel 50 to the atmosphere. Pressure sensor 56 is in fluid communication with vent line conduit 52 to sense the pressure of the gasses in the upper portion of vessel 50 and line 52 and generate a signal indicative of the pressure sensed. Pressure sensed 56 may be any of the pressure sensors well known to those of the art. Drain line 66 leads from the bottom most portion of vessel 50 to liquid drain valve 13 which may be opened to allow liquid refrigerant to flow from the lower portion of vessel 50 into a refrigerant unit or into a temporary storage vessel attached to valve 13. Liquid sensor 58 is located at a point on the wall of vessel 50 between the top and bottom of vessel 50, preferably below refrigerant injection point 46. Liquid sensor 58 may be a photo electric sensor or any other suitable sensor known to those skilled in the art.

In the preferred embodiment, microprocessor 60 receives pressure indicative signals generated by pressure sensor 56 and liquid presence signals from liquid sensor 58 and, dependent upon the signals received, controls display device 62 to display a prompt to prompt the operator of refrigerant purification and recovery apparatus 10 to open valve 54 or valve 13 at appropriate times for appropriate periods. Only when microprocessor 60 receives a pressure indicative signal from pressure sensor 56 indicative of a pressure higher than a predetermined pressure and a liquid indicative signal from liquid sensor 58 indicative of a liquid present at the sensor, microprocessor 60 will cause display 62 to prompt the operator to open liquid drain valve 13 to drain liquid from vessel 50. Only when microprocessor 60 receives a pressure indicative signal from pressure sensor 56 indicative of a pressure higher than a predetermined pressure and a liquid presence indicative signal from liquid sensor 56 indicative of no liquid present at the location of liquid sensor 58 on the wall of vessel 50, microprocessor 60 will cause display 62 to prompt the operator of refrigerant recovery-purification apparatus 10 to open vent valve 54 to vent "noncompressible" gases from the upper most portion of vessel 50 to the atmosphere.

Those familiar with the art will recognize that valves 13 and 54 may be power operated valves, such as solenoid controlled valves, and microprocessor 60 may be arranged to automatically operate those valves in accordance with signals received from pressure sensor 56 and liquid sensor 58 in addition to, or instead of, causing an operator prompt to be displayed on display 62. In the preferred embodiment, the predetermined pressure at which purging of "noncompressible" gases or drawing off of liquid refrigerant will be initiated may be set by means of an input device such as keyboard 64 so that an appropriate pressure may be selected at which to vent or drain the vessel 50 dependent upon the particular type of refrigerant which is being purified and recovered.

Refrigerant recovery-purification apparatus 10 further comprises a line temperature sensor 70 for sensing the temperature of the exterior surface of the downstream end of conduit 43 of recovery-purification apparatus 10 and generating a temperature indicative signal indicative of the temperature sensed. When microprocessor 60 receives a temperature indicative signal from line temperature sensor 70 indicative of a temperature above a predetermined temperature range over which condenser 40 will cool compressed refrigerant at a rate sufficient for adequate condensation to occur, microprocessor 60 causes display 62 to prompt the operator of refrigerant purification and recovery apparatus 10 to connect auxiliary condenser 80 to purification and recovery apparatus 10.

Exemplary purification and recovery apparatus 10 includes auxiliary valve 82 located between condenser 40 and filter 44 in conduit 43. Releasable connectors 84, 86 are located on conduit 43 upstream and downstream of auxiliary valve 82, respectively. Auxiliary condenser 80 is provided with connectors 88 and 90 at its upstream and downstream end, respectively, which are adapted to releasably engage connectors 86, 84, respectively, and provide fluid communication between the upstream and downstream ends of auxiliary condenser 80 and conduit 43. Thus, with releasable connectors 86, 84 connectors with upstream connector 88 and downstream connector 90 of auxiliary condenser 80, respectively, and valve 82 turned to a closed condition, refrigerant will be caused to flow through auxiliary condenser 80 for additional cooling of the high pressure refrigerant. Auxiliary condenser 80 may be provided with a fan to augment heat transfer to the ambient air, or may include a water jacket or similar provision to allow cooling of the high pressure refrigerant by other available fluid heat sinks. Releasable connectors 84, 86 may be of any type well known to those knowledgeable of the art, for example, connectors 84, 86 may comprise externally threaded nipples with Schrader-type valves, while auxiliary connectors 90, 88 may include flanges with overlying internally threaded rings, sized to cooperate with the external threads of the nipples, and central pin elements to open the Schrader-type valves and provide fluid communication between auxiliary condenser 80 and conduit 43 when the rings are engaged with the external threads and the flanges pulled down on releasable connectors 84, 86 by turning the rings.

During periods of high load or high ambient temperature, increased cooling of compressor 20 of refrigerant recovery and purification apparatus 10 may be accomplished by opening valve 98. When valve 98 is an open position, liquid refrigerant under pressure will flow from the lower portion of receiver-separator vessel 50 through drain conduit 66, interconnect conduit 67, valve 98, and interconnect conduit 68 to be introduced into conduit 17. Thus, with valve 98 in the open position, liquid refrigerant form receiver-separator vessel 50 will expand to gas phase and mix with and cool the suction side refrigerant flow entering compressor 20. In the preferred embodiment of FIG. 1, valve 98 is a ball valve but may be any suitable valve well known to those knowledgeable of the art.

Those familiar with the art will recognize that control-signal devices other than microprocessor 60 may be used to prompt the operator of purification recovery apparatus 10 or to effect automatic operation of valves 13 and 54 to purge "noncompressible" gases and drain refrigerant from vessel 50 as appropriate. For example, an analog electrical circuit, such as control circuit 400 of FIG. 4, may be used to prompt the operator by means of labeled or colored lights.

Figure 4:
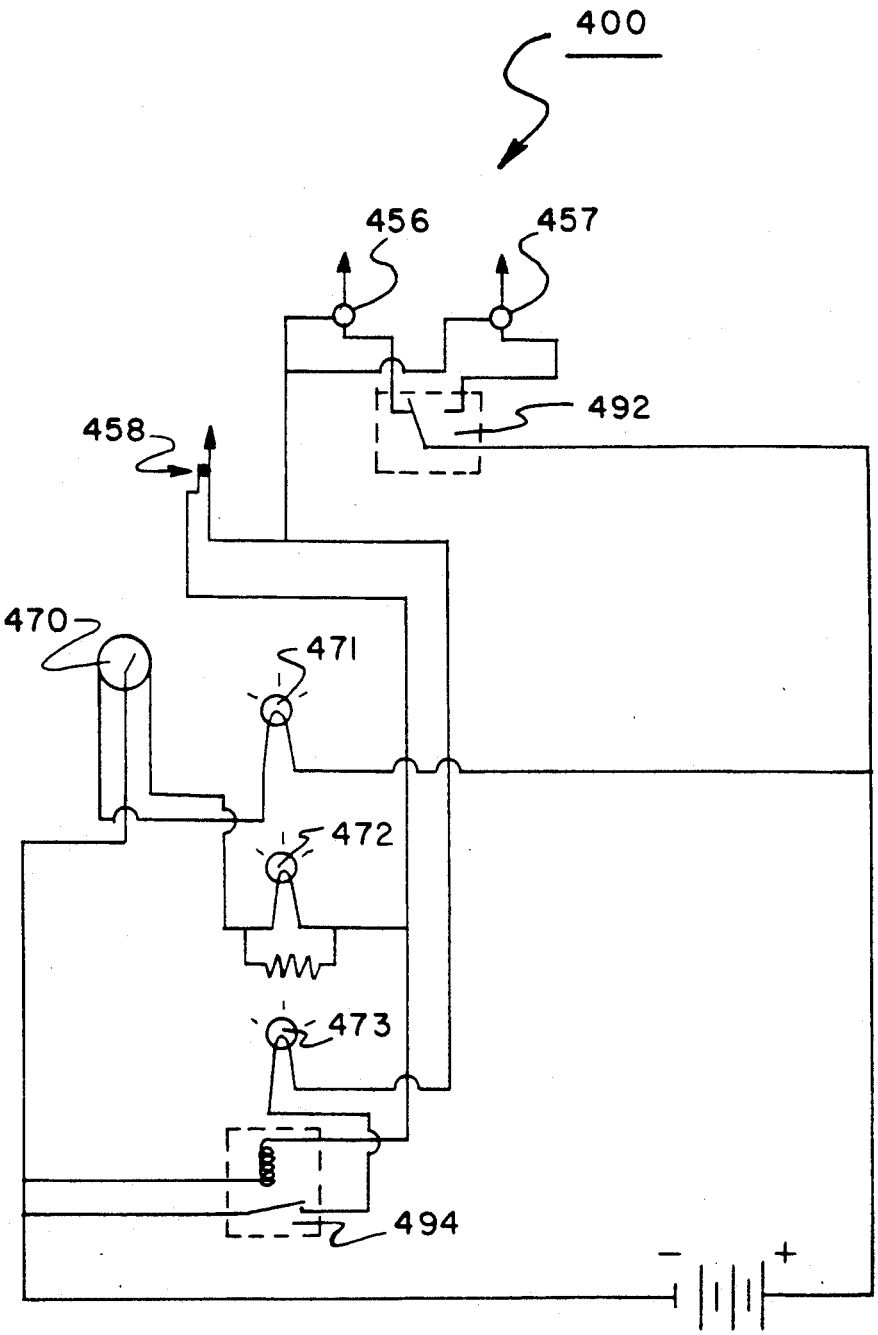
FIG. 4 is a schematic circuit drawing of an electrical control-signal circuit of a refrigerant purification and recovery device comprising an alternative embodiment of the present invention.

Exemplary control-signal circuit 400 causes an appropriate one of high line temperature prompt light 471, vent prompt light 472 or drain prompt light 473 to light in response to high line temperature, as determined by line temperature sensor 470, pressures sensed in the receiver-separator vessel, as detected by pressure sensor switch 456 or 457, and liquid level in the receiver-separator vessel, as determined by liquid sensor 458. At line temperature above a predetermined temperature, temperature detector 470 will open the vent prompt light portion of control-signal circuit 400 including vent light 472 and close the portion of control-signal circuit 400 including high line temperature light 471 to energize high line temperature light 471 and prompt an operator of the refrigerant recovery and purification apparatus to install auxiliary condenser 80. Two position toggle switch 492 provides selection between low threshold pressure sensor switch 456 and high threshold pressure sensor switch 457 as appropriate for the particular type of refrigerant being recovered and purified. In the illustration of FIG. 4, low threshold pressure sensor 456 is selected. When the pressure in receiver-separator vessel 50 exceeds the low threshold pressure, pressure sensor 456 will close the sensor portion of control-signal circuit 400 to energize vent prompt light 472 or drain prompt light 473. Optical liquid sensor 458 imposes a voltage drop between pressure sensor 456 and vent prompt light 472 which varies dependent upon the presence or absence of liquid as sensed by sensor 458. When liquid sensor 458 senses liquid, a large voltage drop is imposed and, when the pressure sensor portion of control-signal circuit 400 is closed, drain prompt light 473 will be energized, while vent prompt light 472 will be illuminated. When liquid sensor 458 does not sense the presence of liquid, little or no voltage drop is imposed upon the vent prompt light portion of control-signal circuit 400 and, when the pressure sensor portion of control-signal circuit 400 is closed, vent prompt light 473 will be energized together with relay 494. Thus, relay 494 will open the drain prompt light circuit including drain prompt light 473, deenergizing drain prompt light 473, and only vent prompt light 472 will be energized and illuminated. In this manner, control-signal circuit 400 prompts an operator of the apparatus to drain liquid refrigerant from receiver-separator vessel 50 only when the pressure within the vessel exceeds a predetermined threshold pressure and the liquid in the vessel is above a predetermined level, and prompts an operator of the apparatus to vent the gasses from the receiver-separator vessel only when the pressure within the vessel is above a predetermined pressure and the liquid level in the vessel is below a predetermined liquid level.

Figure 2:
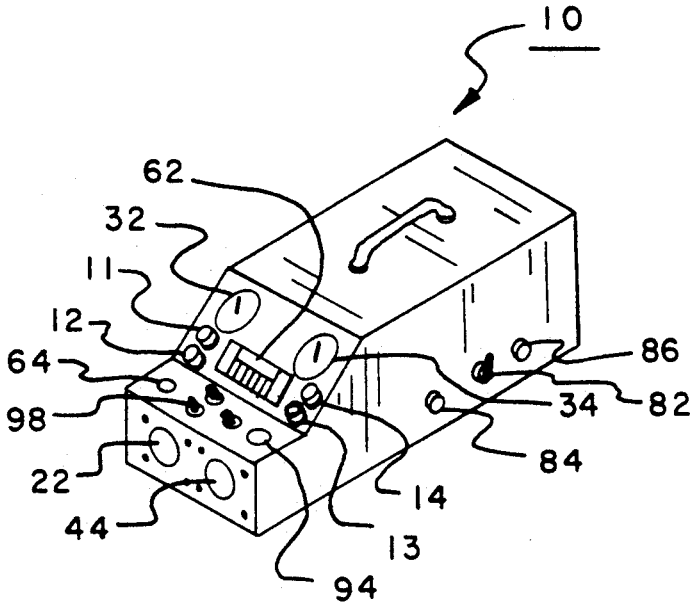
FIG. 2 is an isometric pictorial view showing the front of a refrigerant purification and recovery unit comprising an embodiment of the present invention in its cabinet.
Figure 3:
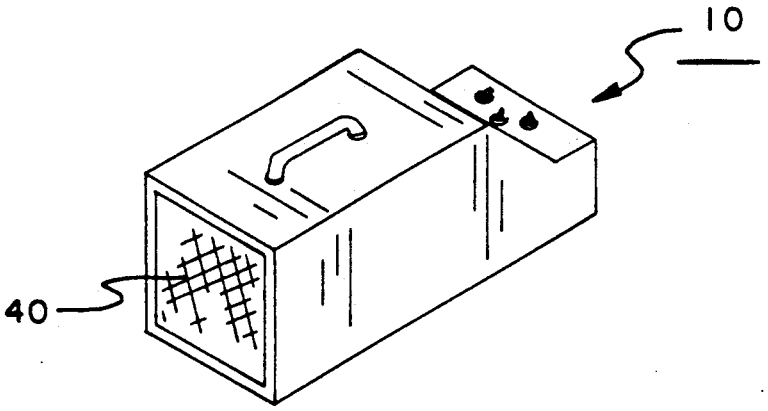
FIG. 3 is an isometric pictorial view showing the back of the refrigerant purification and recovery unit of FIG. 2.

As may be seen from FIGS. 1, 2 and 3, refrigerant purification and recovery apparatus 10 also includes suction gauge 32 and high pressure gauge 34 to allow an operator of refrigerant purification recovery apparatus 10 to monitor its operation. Further, high pressure release valve 36 is provided on the upper portion of vessel 50 to bleed gas from the upper portion of vessel 50 should pressure in the vessel exceed a predetermined safe operating pressure. Cut out pressure sensor 38 is provided on conduit 28 to sense the pressure of the high pressure refrigerant and, should the pressure exceed a predetermined safe operating pressure, cut off power to compressor 20. Sight glass 94 is provided on interconnect conduit 66 in fluid communication with the lower end portion of receiver-separator vessel 50 and includes a moisture monitor, which may be of any of the many types known to those familiar with the art. Sight glass 94 may, for example, change color to indicate moisture is present in the recovered refrigerant. Should excess moisture be present, valve 98 may be opened to allow recovered refrigerant to recirculate via drain line 66 and interconnect lines 67, 68 to again pass through filter 25, including a desiccant, until moisture is sufficiently removed from the recovered refrigerant.

Compressor 20 may be a hermetically sealed compressor such as are commonly used in refrigeration units. Such compressors are intended to recirculate a known quantity of refrigerant in a closed fluid loop to which an appropriate amount of lubricant is introduced to lubricate the compressor. Compressor 20, however, is subject to contaminated refrigerant charges whose lubricant content is unknown and uncontrollable. Thus, oil sensor 21 is provided in the housing of compressor 20 and generates an oil indicative signal indicative of the amount of oil in the housing of compressor 20 which is received by microprocessor 60. When microprocessor 60 receives an oil indicative signal indicative of a low oil level in the housing of compressor 20, microprocessor 60 causes display 62 to display a prompt to prompt the operator of refrigerant purification and recovery apparatus 10 to add oil to compressor 20. Upon such a prompt, the operator may introduce oil to the housing of compressor 20 through suction side valve 12. Drain valve 20 is also provided in the housing of compressor 20 to allow an excess charge of oil to be removed.

As indicated above, refrigerant purified and removed by purification and recovery apparatus 10 may be drained from valve 13 into a temporary storage container or, connector-valve 13 may be directly connected to the high pressure side of the fluid circuit of the refrigeration unit to directly reintroduce the purified refrigerant into the fluid circuit of the refrigeration unit. Those familiar with the art will recognize that, under appropriate operating conditions, connector-valve 12 may be connected to the fluid circuit of the refrigeration unit on the suction side of the compressor of the refrigerant unit and connector-valve 24 connected to the fluid circuit of the refrigeration unit on the high pressure side of the refrigeration unit and valves 12 and 14 opened, while valves 11, 13 and 54 are closed, to allow compressor 20 of recovery and purification apparatus 10 to be utilized in place of a disabled compressor of a refrigeration unit on a temporary basis.

While exemplary refrigeration purification and recovery apparatus comprising a preferred embodiment of the present invention has been shown, it will be understood, of course, that the invention is not limited to that embodiment. Modification may be made by those skilled in the art, particularly in light of the foregoing teachings. For example, while microprocessor and electrical circuit means for controlling the venting of non-compressible gases and liquid refrigerant from the receiver-separator vessel have been shown, fluid or pneumatic circuits, may be utilized to cause display prompts and/or activate the vent and drain valves. It is, therefore, contemplated by the appended claims to cover any such modification which incorporates the essential features of this invention or which encompasses the spirit and scope of the invention.

We claim:

1. A refrigerant purification and recovery apparatus for removing refrigerant from a refrigeration unit and for purifying the refrigerant removed from the refrigeration unit comprising:

compressor means for compressing refrigerant gas;

first conduit means for conducting refrigerant from the a fluid circuit of the refrigeration unit to the compressor, said first conduit means having an upstream end and a downstream end, said first conduit upstream end including coupling means for coupling said first conduit in fluid communication with the refrigeration unit fluid circuit, said first conduit downstream and connected to a suction side of said compressor;

condenser means for facilitating heat exchange from refrigerant within said condenser means to fluid external of said condenser means;

second conduit means for conducting fluid from a high pressure side of said compressor to said condenser, said second conduit means having an upstream end and a downstream end, said second conduit means upstream end attached to said compressor and said second conduit means downstream end attached to said condenser;

receiver-separator vessel means for receiving and containing refrigerant at a pressure higher than an ambient pressure, said receiver-separator vessel means having an upper end portion and a lower end portion;

third conduit means for conducting refrigerant from said condenser to said receiver-separator means, said third conduit means having an upstream end and a downstream end, said third conduit means upstream end connected to said condenser and said third conduit downstream end connected to said receiver-separator means;

pressure detection means for generating pressure indicative signals representative of a pressure within said upper end portion of said receiver-separator means;

liquid detection means for detecting the presence of a liquid in said receiver-separator means at a position between said upper end portion and said lower end portion and generating a liquid-presence indicative signal indicative of the presence or absence of liquid;

vent means for venting gas from said upper end portion of said receiver-separator means;

drain means for draining liquid from said lower end portion of said receiver-separator means;

control-signal means for receiving said pressure indicative signals and said liquid-presence indicative signals and generating a drain signal only when said pressure indicative signal is indicative of a pressure greater than a predetermined pressure and said liquid presence indicative signal is indicative of a liquid present, and generating a vent signal only when said pressure indicative signal is indicative of a pressure greater than a predetermined pressure and said liquid presence indicative signal is indicative of no liquid present.

2. A refrigerant purification and recovery apparatus as in claim 1, further comprising portable containment means for receiving and containing refrigerant drained from said receiver-separator means.

3. A refrigerant purification and recovery apparatus as in claim 1, further comprising lubricant sensing means for sensing an amount of lubricant in a housing of said compressor means.

4. A refrigerant purification and recovery apparatus as in claim 1 further comprising lubricant draining means for draining a lubricant from a housing of said compressor means.

5. A refrigerant purification and recovery apparatus as in claim 1 in which said first conduit means includes filter means for filtering refrigerant flowing within said first conduit means.

6. A refrigerant purification and recovery apparatus as in claim 1 in which said third conduit means includes filter means for filtering refrigerant flowing within said third conduit means.

7. A refrigerant purification and recovery apparatus as in claim 1 in which said first conduit means includes filter means for filtering refrigerant flowing within said first conduit means and said second conduit means includes filter means for filtering refrigerant flowing within said second conduit means.

8. A refrigerant purification and recovery apparatus as in claim 1 further comprising:

interconnect conduit means including valve means for interconnecting said receiver vessel and said first conduit, said interconnect conduit means having a receiver vessel end in fluid communication with said receiver vessel and a suction end in fluid communication with said first conduit, said valve means for controlling flow within said interconnect conduit and having an open and a closed position, such that, when said valve means is in the open position, refrigerant may flow from said receiver vessel means into said first conduit means.

9. A refrigerant purification and recovery apparatus as in claim 1 in which said drain signal is a display of a first light and said vent signal is a display of a second light.

10. A refrigerant purification recovery apparatus as in claim 9 further comprising heat exchanger means for exchanging heat between fluid conducted by said first conduit means and fluid conducted by said second conduit means.

11. A refrigerant purification recovery apparatus as in claim 10, said display means further comprising acoustic signaling means for generating an acoustic signal.

12. A refrigerant purification and recovery apparatus as in claim 1 in which said control-signal means includes a microprocessor.

13. A refrigerant purification and recovery apparatus as in claim 12, further comprising display means for displaying prompts to prompt an operator to cause said vent means to vent gas and to prompt and operator to cause said vent means to vent gas and to prompt an operator to cause said drain means to drain liquid.

14. A refrigerant purification and recovery apparatus as in claim 1 further comprising:

vent control means for causing said vent means to vent gas from said receiver-separator vessel means when said vent signal is generated; and drain control means for causing said drain means to drain liquid from said receiver-separator vessel means when said drain signal is generated.

15. A refrigerant purification and recovery apparatus as in claim 14, in which said vent control means comprises a solenoid and said drain control means comprises a solenoid.

16. A method for purifying refrigerant comprising the steps of:

compressing the refrigerant;

passing the refrigerant through a condenser to remove heat from the refrigerant to cause a portion of the refrigerant to condense to a liquid phase;

passing the refrigerant into a containment vessel with a vent at its top and a draining means at its bottom;

sensing a liquid level of liquid refrigerant in a bottom portion of the vessel;

sensing the pressure of gases in a top portion of the vessel;

allowing gas to vent from the top of the vessel only when the liquid refrigerant is below a predetermined level and the gas pressure is above a predetermined pressure; and allowing liquid to drain from the bottom of the vessel only when the liquid refrigerant is above a predetermined level and the gas pressure is above a predetermined pressure.

* * * * *